US006289924B1

(12) United States Patent
Kozinski

(10) Patent No.: US 6,289,924 B1
(45) Date of Patent: Sep. 18, 2001

(54) VARIABLE FLOW AREA REFRIGERANT EXPANSION DEVICE

(76) Inventor: Richard C. Kozinski, 27671 Dowland, Warren, MI (US) 48092

( * ) Notice: Subject to any disclaimer, the term of this patent is extended or adjusted under 35 U.S.C. 154(b) by 0 days.

(21) Appl. No.: 09/512,177

(22) Filed: Feb. 24, 2000

(51) Int. Cl.[7] ..... F16K 31/122; F25B 41/06

(52) U.S. Cl. ..... 137/504; 137/497; 138/46; 62/528

(58) Field of Search ..... 137/497, 504; 138/46; 62/528

(56) References Cited

U.S. PATENT DOCUMENTS

| | | | | |
|---|---|---|---|---|
| 3,421,542 | * | 1/1969 | Adams et al. | 137/504 |
| 4,009,592 | | 3/1977 | Boerger . | |
| 4,375,228 | | 3/1983 | Widdowson . | |
| 4,856,292 | * | 8/1989 | Kawai et al. | 137/494 |
| 4,951,478 | * | 8/1990 | McDonald | 137/504 |
| 5,081,847 | | 1/1992 | Anderson, Jr. . | |
| 5,134,860 | * | 8/1992 | Drucker | 137/513.3 |
| 5,170,638 | | 12/1992 | Koenig et al. . | |
| 5,894,741 | * | 4/1999 | Durham et al. | 62/528 |
| 5,901,750 | | 5/1999 | Kozinski . | |

* cited by examiner

*Primary Examiner*—Gregory L. Huson
*Assistant Examiner*—Ramesh Krishnamurthy
(74) *Attorney, Agent, or Firm*—Rader, Fishman & Grauer PLLC

(57) ABSTRACT

A refrigerant flow metering device for use in a refrigeration system which uses a movable piston with a fixed flow passage in series with a variable area flow passage. The variable flow area is defined by the position of the piston relative to the containing housing. The position of the movable piston is a function of refrigerant pressure differential across the piston and the force of a spring member acting in an opposite direction on the piston. The variable flow area is defined as the clearance between a tapered fixed housing and the tapered portion of the movable piston. The piston is sealed via an "O" ring seal causing fluid to flow first through a fixed bore and then through the variable flow area.

10 Claims, 4 Drawing Sheets

VARIABLE FLOW AREA REFRIGERANT EXPANSION DEVICE

FIELD OF THE INVENTION

The invention relates generally to variable flow metering devices and more particularly to variable flow area refrigerant expansion devices for use in controlling compression refrigeration systems so as to be responsive to a pressure differential between high and low pressure areas of a refrigeration system.

BACKGROUND OF THE INVENTION

Most small commercial vehicles and particularly automotive and mobile air conditioning systems, as represented in FIG. 1, utilize a fixed area refrigerant expansion device for flow control to reduce or eliminate moving parts and reduce costs. Known fixed area expansion devices are long capillary tubes or relatively short orifice tubes in the high-pressure liquid line between the condenser and evaporator. The refrigerant flow is primarily dependent on the inlet pressure (head pressure) at the orifice and the amount of liquid subcooling. In fixed area expansion devices, increasing head pressure or subcooling increases flow while increasing gas at the inlet decreases flow. Suction pressure changes have no effect on flow in normal system operation at higher ambient since flow is at "sonic" velocity and suction pressure is usually below the pressure at which this sonic flow occurs. As described in detail in my U.S. Pat. No. 5,901,750, incorporated herein by reference, these characteristics make the fixed area expansion device or capillary tube self regulating and produces adequate performance in a wide range of conditions encountered in normal automotive air conditioner operation with the exception of performance at idle. In automotive use the fixed orifice tube is sized for high ambient load at high speed vehicle operation and is generally about twice as large at idle as is optimal, resulting in increased compressor horsepower and a reduction in cooling. FIG. 2 depicts a performance chart of a typical automotive system using a fixed orifice tube versus that of smaller orifices at idle.

Another known expansion device for use in flow control in refrigerant systems is a thermostatic expansion (TXV) valve. A TXV valve is a variable area expansion device and operates to control the flow rate of liquid refrigerant entering the evaporator as a function of the temperature of the refrigerant gas leaving the evaporator. However, while fixed area devices cannot match the efficiency of the TXV except at certain defined operating conditions, TXV valves are more complicated to manufacture and thus, more costly than the fixed devices.

An example of an automotive refrigerant system operation at high vehicle operation speed as compared to vehicle idle is as follows: At high operation speeds the head pressure may be approximately 250 PSIG and the sub-cooling 20° F. with a system capacity of approximately 24,000 BTU/Hr. At idle the head pressure of the vehicle rises to 350 PSIG due to reduction of condenser air flow and re-circulation of hot under-hood air into the condenser. Accordingly, balance is achieved at idle by reducing sub-cooling at the expansion device inlet. Initially, the rise in head pressure increases flow through the orifice tube. The result is that the sub-cooled liquid in the condenser is flushed out and uncondensed gas enters the orifice tube inlet. Gas greatly reduces flow until the flow rate out of the compressor is equal to flow through the orifice tube. Since capacity per pound of refrigerant is a function of liquid percentage after expansion, a gaseous mixture entering the expansion device greatly reduces capacity and system efficiency. At idle this capacity reduces to 12,000 BTU/Hr. in this example. If a smaller flow area is utilized in the expansion device refrigerant flow is reduced allowing liquid backup in the condenser and thus sub-cooling to occur. The net result is more cooling at reduced compressor work.

However, when small orifice are used at high load high speed operational conditions, more refrigerant is required in the system as more back up of liquid occurs until enough subcooling and head pressure are available to again flow enough to satisfy evaporator requirements. Unfortunately, this causes the head pressure to rise to the range of 300–400 PSIG, substantially reducing the compressor life. Accordingly, the variable flow orifice must be adequate in flow area at high speed high load conditions, in order to operate satisfactory. Further, a very short orifice tube relative to it's diameter becomes more restrictive as sub-cooling is increased. This characteristic of the short orifice tube is a detriment in automotive use since flow starvation may occur at high vehicle operational speeds if the small orifice size is engaged. Starvation results in high compressor discharge superheat temperatures, which may be very detrimental to compressor durability.

An object of this invention is to provide a variable flow area valve sensitive to system operating pressure.

Another object of this invention is to provide a metering valve, which closely matches the flow characteristics of a capillary or orifice tube as opposed to a short orifice plate.

Another object of this invention is to isolate the spring from refrigerant flow for reasons of vibration, durability, and noise.

SUMMARY OF THE INVENTION

In accordance with the invention, a variable flow area refrigerant expansion device includes a valve body having an axially extending aperture therethrough, a piston member slidably received in the valve body aperture, and a spring member operatively connected to the piston to resiliently urge the piston in a predetermined direction in the valve body aperture to insure fluid flow through the expansion device. The valve body aperture includes an inlet end and an outlet end. In accordance with one aspect of the invention, the interior surface of the valve body aperture at the outlet end is tapered from a first diameter to a second diameter, wherein the first diameter is larger than the second diameter, and terminates in a bore. The bore is a preferably a cross-bore.

The piston includes a flow passageway partially extending therethrough, with an inlet end and an outlet end. The outlet end terminates in a cross-bore formed though the piston body. In accordance with the invention, the piston further includes a tapered portion positioned downstream from the direction of fluid flow through the expansion device. The tapered portion has a first end defined by a first diameter and a second end defined by a second diameter, where the first diameter is larger than the second diameter. The piston is positioned within the valve body aperture with the tapered portion of the piston being received in the tapered outlet end of the valve body. In a preferred embodiment the tapered portion of the piston is tapered to a first predetermined angle and the tapered outlet end of the valve body is tapered to a second predetermined angle such that the tapers are not parallel to provide a mechanism for metering fluid through the expansion valve in response to pressure differentials between the inlet and outlet ends of the valve body.

In one embodiment, the spring member is disposed around the outer surface of the piston and contacts an annular wall within the valve body to resiliently urge the spring into a full open position. Alternatively, the valve body may be formed with a spring chamber positioned downstream of a distal end of the piston, such that an end of the spring engages the distal end of the piston to resiliently urge the spring into a full open position.

In accordance with another aspect of the invention, to insure that fluid flows through the passageway in the piston, it is preferred that the device include at least one valve body seal and at least one piston seal member. An outer surface of the valve body is preferably formed with an annular groove to receive a valve body seal, such as an O-ring. A second annular groove and valve body seal are preferably provided as a back-up seal, downstream of the first annular groove.

The interior surface of the valve body inlet end is preferably provided an annular surface for engaging piston seal member. In a preferred embodiment, the expansion device further includes a screen member that is connected to the inlet end of the valve body. A distal end of the screen member cooperates with the annular shoulder provided on the interior surface of the valve body such that the piston seal member is captured therebetween, thereby reducing the requirement for rigid tolerances to adequately retain piston seal member. Alternatively, the interior surface of the valve body may include an interior annular groove for retaining the piston seal member, or the inlet end of the piston may be provided with an annular groove for receiving the piston seal member.

In accordance with another aspect of the invention, it is preferred that a screen member is connected to the valve body by a snap-fit connection. Accordingly, the screen member is preferably provided with outwardly extending tang members that engage recesses formed in the interior surface of the valve body inlet end. Alternatively, the screen member may be molded onto the inlet end of the valve body or threadedly connected thereto.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

Figure 1:
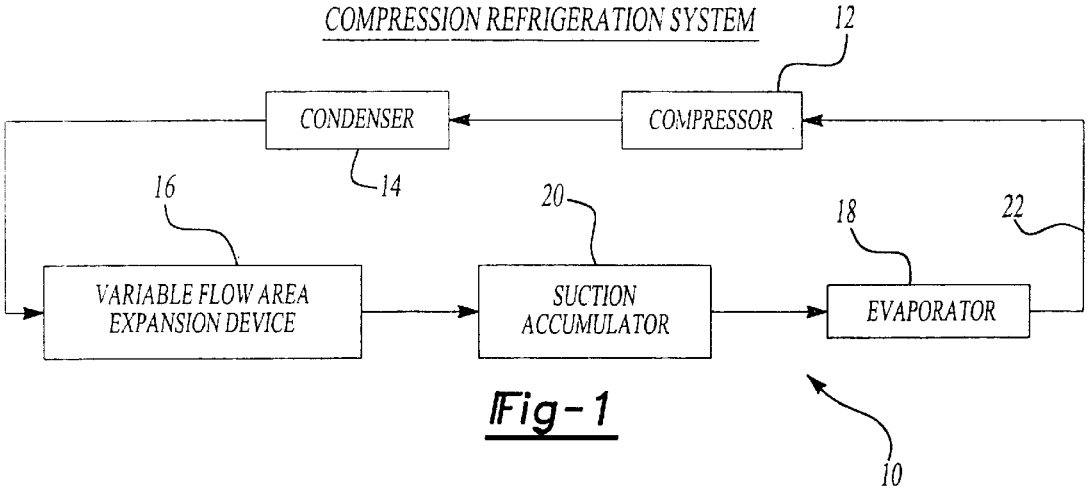
FIG. 1 is a schematic diagram of a compression refrigeration system utilizing a variable flow area refrigerant expansion device in accordance with the present invention.
Figure 2:
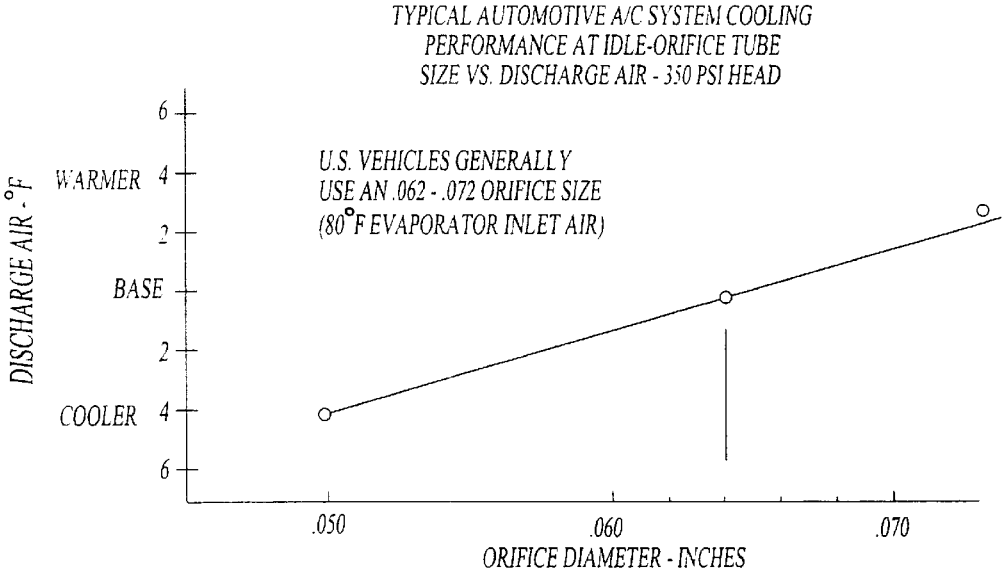
FIG. 2 is a graphical representation of automotive system cooling performance vs. orifice size at idle conditions.

Referring to FIG. 1, a compression refrigeration system 10 is shown. System 10 is typical of that found in many air conditioning applications especially in automotive use. System 10 includes a compressor 12, a condenser 14, an expansion device 16, and an evaporator 18. In a preferred embodiment, system 10 further includes an optional suction accumulator 20. Suction accumulator 20 is desirable in highly variable air conditioning load applications for storing refrigerant, to prevent compressor slugging and to allow refrigerant to be displaced from low pressure and high pressure areas. The components of system 10 are connected together by refrigerant lines to form a refrigerant circuit. In operation, compressor 12 is driven by a vehicle engine (not shown) and compresses refrigerant vapor to a temperature above the ambient condenser air temperature. Refrigerant is delivered from compressor 12 as high pressure vapor to an inlet of condenser 14 by a compressor discharge line (not shown). The condenser 14 removes heat from this vapor in a conventional manner and condenses all or most of this vapor to a liquid. This high-pressure refrigerant then is discharged as high pressure refrigerant liquid to a high-pressure liquid line 22 that is fluidly connected to the evaporator 18. The expansion device 16 of the present invention is positioned within liquid line 22 between condenser 14 and evaporator 18.

Once fluid flows to expansion device 16, it is expanded to a low-pressure mixture of liquid and gas. This mixture flows to evaporator 18 where most or the entire liquid portion is evaporated as heat is absorbed from an external heat source such as relatively warm humid air. In automotive applications the refrigerant vapor along with oil and a small percentage of liquid flows then to suction accumulator 20 where all of the vapor and again a small percentage of liquid is metered back to compressor 12 where the cycle is repeated.

Figure 3:
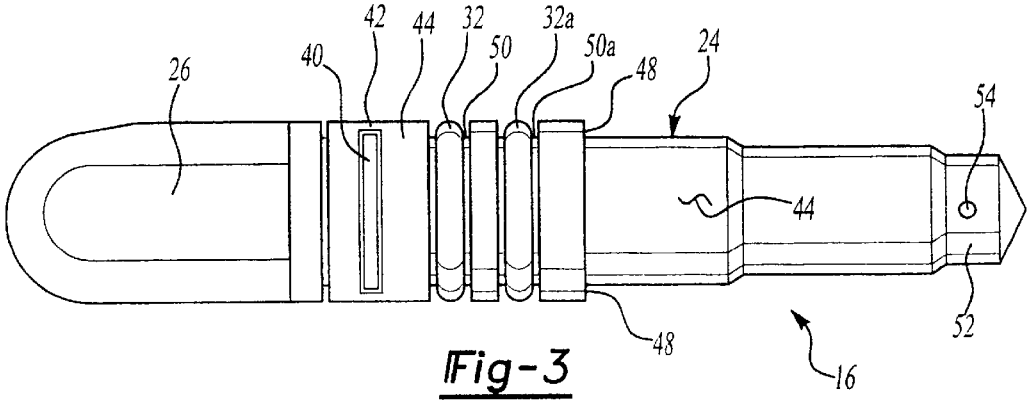
FIG. 3 is a side view of the variable flow area refrigerant expansion device in accordance with the present invention.
Figure 4:
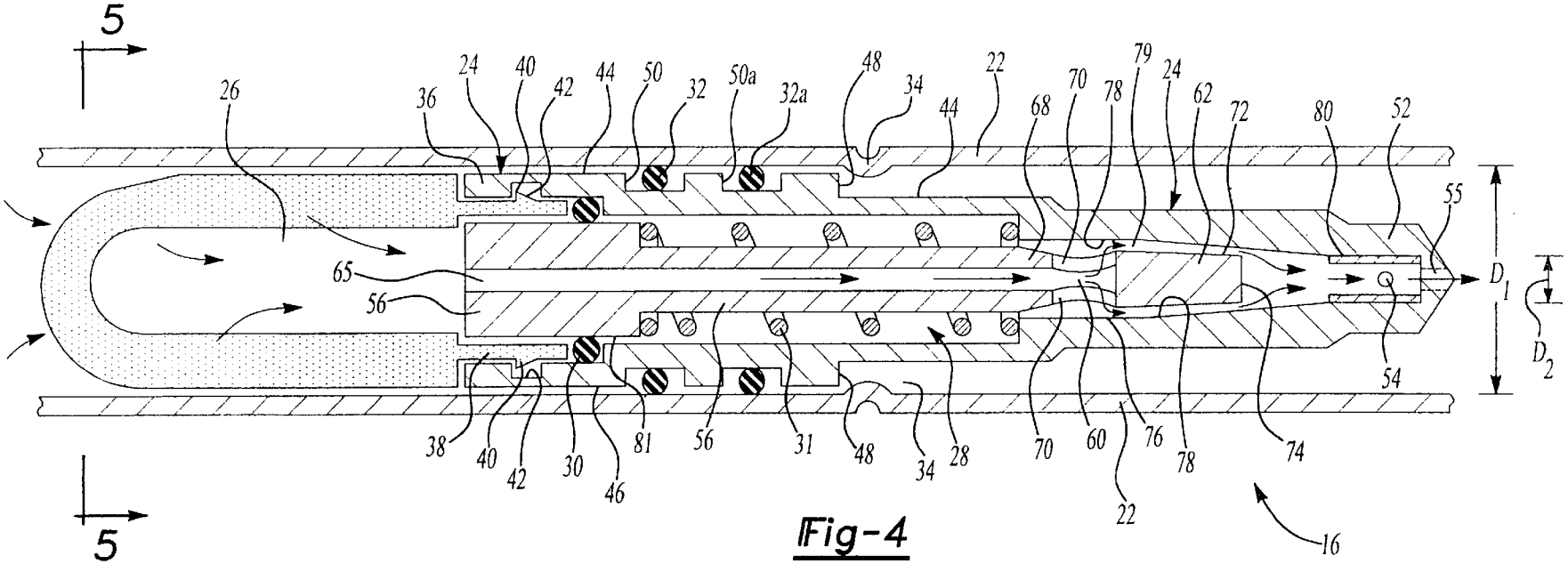
FIG. 4 is a side cross sectional view of the variable flow area refrigerant expansion device in accordance with the present invention.
Figure 5:
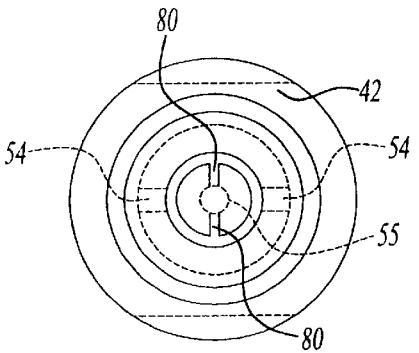
FIG. 5 is an end view of the variable flow area refrigerant expansion device shown in FIG. 4 from a screen entrance end portion.

Referring to FIGS. 3–5, expansion device 16 will be described in greater detail. Expansion device 16 consists of a valve body 24, a screen assembly 26, a piston 28, piston sealing member 30, spring member 31 and at least one expansion device sealing member 32. The device is shown positioned in line 22, wherein line 22 further includes crimped portions 34 that extend radially inwardly to keep expansion device 16 in place within line 22.

Screen assembly 26 is positioned at and operatively connected to an inlet end 36 of valve body 24 by means of an annular snap-fit end portion 38. End portion 38 includes outwardly extending tang members 40 that engage an annular groove 42 formed within an internal surface 44 of valve body 24. While a snap-fit connection is preferred to operatively connect screen assembly 26 to valve body 24, other suitable connection members may be employed, such as threaded connections.

Valve body 24 is generally hollow with a cylindrical outer surface 44 and having stepped sections with varying outer diameters. The first section 46 at inlet end 36 of valve body 24 has the largest diameter $D_1$ that is sized to closely fit within line 22 and is open to receive piston 28, as explained in further detail below. First section 46 terminates at annular surface 48 which abuts against crimped portions 34 to retain valve body 24 within line 22. Outer surface 44 of first section 46 includes at least one annular groove 50 formed therein to receive expansion device sealing member 32. Preferably, sealing member 32 is an O-ring, although other suitable sealing members may be employed. To insure against refrigerant flowing around expansion device 16 in the event of a failure of sealing member 32, in the preferred embodiment, there is a second expansion device sealing member **32*a* positioned within a second annular groove 50*a* downstream of sealing member 32. In one preferred embodiment, a distal end 52 of valve body 24 has a cross-bore 54 formed therethrough to permit fluid to flow through expansion device 16, to be explained in further detail below. Alternatively, distal end 52 may be formed with a through bore 55, represented in phantom in FIG. 4**.

Piston 28 is movably positioned within valve body 24. Piston 28 has a first cylindrical end portion 56, a main body section 58, an outlet portion 60 and a tapered second end portion 62. Extending partially through piston end portion 56, main body section 58 and terminating at outlet portion 60 is a flow passageway 64. Passageway 64 has an inlet 65 positioned adjacent to screen assembly 26 to permit refrigerant to flow through expansion valve assembly 16. Main body section 58 has a diameter $d_2$ that is smaller than the diameter of first cylindrical end portion 56 and receives spring member 31 to counteract piston 28 movement due to pressure differential across the piston 28. Spring member 31 is preferably a calibrated compression spring although other suitable spring members may be used. An end portion 68 of main body section 58 tapers inwardly and terminates in a cross-bore 70. Adjacent to and downstream of cross-bore 70 is tapered second end portion 62. Tapered second end portion 62 has an outer surface 72 that is preferably tapered to a first predetermined angle and terminates at a stop surface 74.

In accordance with one aspect of the invention, when piston 28 is positioned within valve body 24, tapered second end portion 62 is positioned within a flow chamber 76 defined by an interior surface 78 of valve body 24. Interior surface 78 has a tapered portion 79 that cooperates with outer surface 72 of tapered second end portion 62 of piston 28 to meter fluid through expansion valve assembly 16. Preferably, interior surface 79 is tapered at a second predetermined angle so as to provide a sufficiently long orifice tube length when piston 28 is moved in its full open position, downstream, with stop surface 74 abutting stop members 80 formed on the interior surface of distal end 52.

In accordance with another aspect of the invention, to insure that fluid flows though flow passageway 64, expansion device 16 is provided with piston sealing member 30. In a preferred embodiment, sealing member 30 is an O-ring and is positioned around first cylindrical end portion 56. End portion 38 of screen assembly 26 cooperates with an annular surface 48 to retain sealing member 30 on piston 28 and to insure that refrigerant is forced to flow though passageway 64 without requiring machining of an annular ring on an outer surface 81 of first cylindrical end portion 56.

Figure 6:
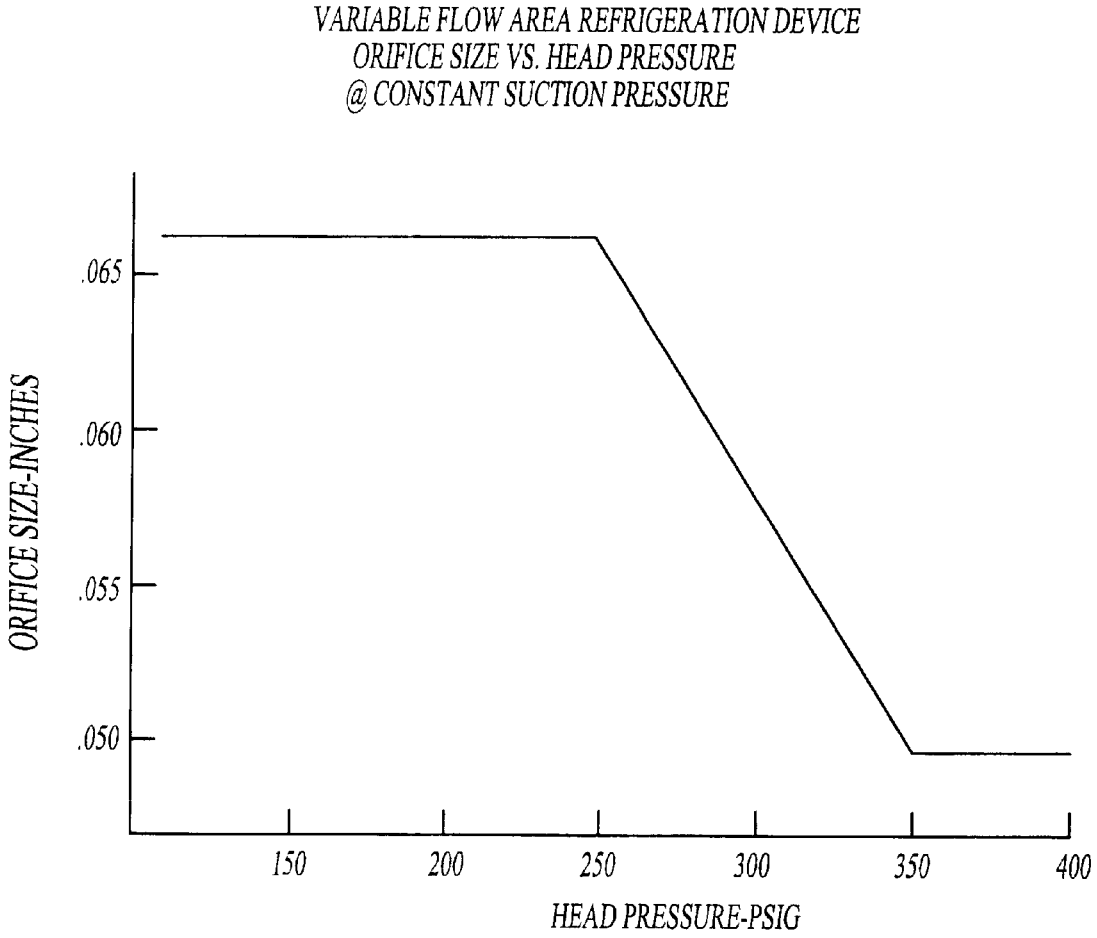
FIG. 6 is a graphical representation of a variable flow area refrigerant expansion device orifice size vs. head pressure.

During system operation, piston 28 is positioned in an open position, with piston 28 being displaced fully leftward such that stop surface 74 of piston 28 is spaced away from stop members 80. Refrigerant flows through screen assembly 26 as shown by flow arrows in FIGS. 3–4, and is forced to enter flow passageway 64 due to piston sealing member 30. Once within flow passageway 64, refrigerant exits piston 28 through cross-bore 70, located upstream of tapered second end portion 62. Refrigerant then flows between tapered second end portion 62 and tapered interior surface 79, metering refrigerant whereby refrigerant exits valve body 28 through cross-bore 54. In accordance with the invention, as refrigerant exits through cross-bore 54, piston 28 begins to move when a predetermined pressure differential acts on piston 28, moving piston rightward such that stop surface 74 of piston moves toward stop member 80. As piston 28 moves rightward within valve body 28, the clearance between tapered second end portion 62 and interior surface 79 decreases. As piston 28 moves rightward against spring member 66, an increase in pressure occurs at chamber 76. This results in a very gradual movement as function of pressure differential across expansion device 16 as piston portion 56 has a decreasing pressure differential in comparison to a smaller tapered 62 cross-section increasing pressure differential. Further, the pressure differential across the piston inlet 65 and chamber 76 varies as a function of refrigerant inlet state—i.e. quality or subcooling. If, when there is equal inlet pressures, vapor (quality) is present in piston inlet refrigerant then pressure will be substantially lower at cross-bore 74 at the outlet of passageway 64 than if subcooled liquid is flowing. With vapor present at idle conditions, expansion device 16 will actuate at substantially lower head pressure as compared to a subcooled refrigerant state, which would exist in high speed vehicle conditions. This results in a large modulation range of orifice size of the expansion device as a function of head pressure at constant suction pressure, as shown in FIG. 6. The cooperating surfaces of tapered second end portion 62 and interior surface 79 are designed to essentially have equal inlet and outlet flow areas at a full rightward position resulting in an adequately long orifice tube length. Accordingly, this invention is responsive to high to low side pressure differential across expansion device 16.

Figure 7:
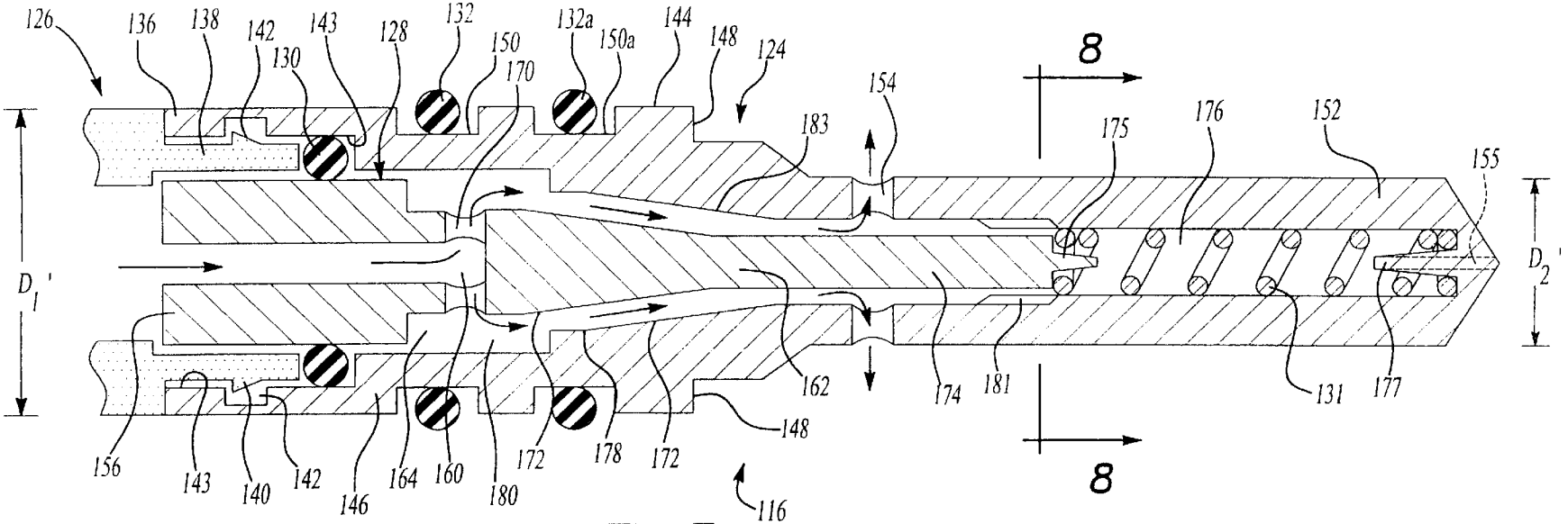
FIG. 7 is a side cross sectional view of an alternative embodiment of a variable flow refrigerant expansion device.
Figure 8:
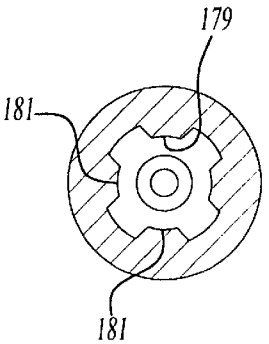
FIG. 8 is a section view of a valve body of the embodiment shown in FIG. 7.

FIGS. 7 and 8 depict and an alternative embodiment of an expansion device 116. Similar to expansion device 16, expansion device 116 includes a valve body 124, screen assembly 126, a piston 128, piston sealing member 130, a spring member 131 and at least one expansion device sealing member 132. Screen assembly 126 is positioned at and operatively connected to an inlet end 136 of valve body 124 by means of an annular snap-fit end portion 138. End portion 138 includes outwardly extending tang members 140 that engage an annular groove 142 formed within an interior surface 143 of valve body 124.

Valve body 124 is generally hollow with a cylindrical outer surface 144 and having stepped sections with varying outer diameters. The first section 146 at inlet end 136 of valve body 124 has the largest diameter $D_1$, that is sized to closely fit within line 22 and is open to receive piston 128, as explained in further detail below. First section 146 terminates at annular surface 148 which abuts against crimped portions 34 to retain valve body 124 within line 22. Outer surface 144 of first section 146 includes at least one annular groove 150 formed therein to receive expansion device sealing member 132. Preferably, sealing member 132 is an O-ring, although other suitable sealing members may be employed. To insure against refrigerant flowing around expansion device 116 in the event of a failure of sealing member 32, in the preferred embodiment, there is a second expansion device sealing member **132*a* positioned within a second annular groove 150*a* downstream of sealing member 132. A distal end portion 152 of valve body 124 has a second diameter $D_2$, that is smaller than diameter $D_1$, has a cross-bore 154 formed therethrough, to be explained in further detail below. Alternatively, distal end 152 may be formed with a through bore 155, represented in phantom in FIG. 7**.

Piston 128 is movably positioned within valve body 124. Piston 128 has a first cylindrical inlet end portion 156, an outlet portion 160 and an elongated tapered second end portion 162. Extending through piston end portion 156 and terminating at outlet portion 160 is a flow passageway 164 that opens into a cross-bore 170. Passageway 164 has an inlet 165 positioned adjacent to screen assembly 126 to permit refrigerant to flow through expansion valve assembly 116. Adjacent to and downstream of cross-bore 170 is elongated tapered second end portion 162. Elongated tapered second end portion 162 has a first outer surface 172 that is preferably tapered to a first predetermined angle that transitions to a cylindrical end portion 174. Cylindrical end portion 174 has an integral extension member 175 that serves as a stop surface. A spring chamber 176 is positioned within valve body 124, which receives spring member 131 to counteract piston 128 movement due to pressure differential across the piston 128. An integral extension member 177 extends inwardly into spring chamber 176 from a distal end 155 of valve body 124 and serves as a stop member that cooperates with integral extension member 175 of tapered second end portion 162. Spring member 131 is positioned within spring chamber 176 on integral extension members 175 and 177. Spring member 131 is preferably a calibrated compression spring although other suitable spring members may be used. To permit debris and dirt to escape from spring chamber 176, an interior surface 179 of valve body 124 is provided with key members 181 of elongated tapered second end portion 162.

In accordance with one aspect of the invention, when piston 128 is positioned within valve body 124, elongated tapered second end portion 162 is positioned within a flow chamber 180 defined by an interior surface 178 of valve body 124. Interior surface 178 has a tapered portion 183 that cooperates with outer surface 172 of elongated tapered second end portion 162 of piston 128 to meter fluid through expansion valve assembly 116. Preferably, interior surface 178 is tapered at a second predetermined angle so as to provide a sufficiently long orifice tube length when piston 128 is moved in its full open position, downstream, with extension members 175 and 177 abutting one another.

In accordance with another aspect of the invention, to insure that fluid flows though flow passageway 164, expansion device 16 is provided with piston sealing member 130. In a preferred embodiment, sealing member 130 is an O-ring and is positioned around first cylindrical end portion 156. End portion 138 of screen assembly 126 cooperates with an annular surface 148 to retain sealing member 130 on piston 128 and to insure that refrigerant is forced to flow though passageway 164 without requiring machining of an annular ring on an outer surface 183 of first cylindrical end portion 156.

During system operation, piston 128 is positioned in an open position, with piston 128 being displaced fully leftward such that extension members 175 and 177 are spaced away from one another. Refrigerant flows through screen assembly 126 as shown by flow arrows in FIGS. 7–8, and is forced to enter flow passageway 164 due to piston sealing member 130. Once within flow passageway 164, refrigerant exits piston 128 through cross-bore 170, located upstream of tapered second end portion 162. Refrigerant then flows between tapered second end portion 162 and tapered interior surface 183, metering refrigerant whereby refrigerant exits valve body 128 through cross-bore 154. In accordance with the invention, as refrigerant exits through cross-bore 154, piston 128 begins to move when a predetermined pressure differential acts on piston 128, moving piston rightward such that integral extension member 175 of piston 128 moves toward extension member 177. As piston 128 moves rightward within valve body 124, the clearance between tapered second end portion 162 and interior surface 183 decreases. As piston 128 moves rightward against spring member 131, an increase in pressure occurs at flow passageway 180. This results in a very gradual movement as function of pressure differential across expansion device 116 as flow chamber 180 has a decreasing pressure differential in comparison to a smaller tapered cross-section increasing pressure differential. This results in a large modulation range of orifice size of the expansion device as a function of head pressure at constant suction pressure, as previously discussed in connection with FIG. 6. The cooperating surfaces of tapered second end portion 162 and interior surface 183 are designed to essentially have equal inlet and outlet flow areas at a full rightward position resulting in an adequately long orifice tube length. Accordingly, this invention is responsive to high to low side pressure differential across expansion device 116.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

I claim:

1. A variable flow area refrigerant expansion device for controlling fluid flow having variable fluid pressure, comprising:

a valve body having an axially extending aperture threrethrough, wherein said aperture includes an inlet end and an outlet end and a flow chamber, wherein an inner surface of said flow chamber is tapered from a first diameter to a second diameter and terminates in a bore at said second diameter, said first diameter being larger than said second diameter;

a piston slidably received in said aperture of said valve body, said piston having a flow passageway partially extending therethrough, said flow passageway having an inlet and an outlet end, wherein said outlet end terminates in a cross-bore formed through said piston, said cross-bore opening into said flow chamber;

wherein said piston includes a tapered portion positioned downstream from said cross-bore, said tapered portion having a first end defined by a first diameter and second end defined by a second diameter, wherein said first diameter of said tapered portion is greater than said second diameter of said tapered portion; and wherein said valve body further includes a spring chamber for receiving a spring member, said spring member being operatively connected to said piston to resiliently urge said piston in a first predetermined direction and positioned downstream of said cross-bore.

2. The variable flow area refrigerant expansion device of claim 1, further including a seal member operatively connected to said piston to direct fluid to flow through said flow passageway.

3. The variable flow area refrigerant expansion device of claim 2, further including a screen member connected to said inlet end of said valve body.

4. The variable flow area refrigerant expansion device of claim 3, wherein said screen member includes a distal end portion having tang members that engage apertures formed in said valve body to retain said screen member to said valve body.

5. The variable flow area refrigerant expansion device of claim 4, wherein said seal member is positioned around said piston and adjacent an annular shoulder formed in said valve body, said distal end portion cooperating with said tang members to operatively retain said seal member on said piston.

6. The variable flow area refrigerant expansion device of claim 1, wherein said tapered inner surface of said flow chamber of said valve body is tapered at a first predetermined angle and said tapered portion of said piston is tapered at a second predetermined angle to meter fluid through said expansion device to meter fluid flowing through said fluid passageway in response to a pressure differential between said inlet and outlet ends of said valve body.

7. The variable flow area refrigerant expansion device of claim 1, wherein a distal end of said tapered second portion further includes an outwardly extending integral extension member for operatively engaging said spring member.

8. The variable flow area refrigerant expansion device of claim 7, wherein an interior wall surface of said valve body further includes an inwardly extending integral extension member for operative engaging said spring member, said inwardly and outwardly extending integral extension members serving as stop members to limit movement of said piston during operation.

9. The variable flow area refrigerant expansion device of claim 1, further including key members integrally formed on an interior surface of said valve body adjacent to a distal end of said tapered portion and said spring chamber.

10. The variable flow area refrigerant expansion device of claim 1, wherein an outer surface of said valve body includes at least one annular groove to receive at least one valve body seal member.

* * * * *